US011957199B2

(12) United States Patent
Binns et al.

(10) Patent No.: US 11,957,199 B2
(45) Date of Patent: Apr. 16, 2024

(54) COMPRESSION HEADWEAR

(71) Applicant: NMN MONDAY LLC, Atlanta, GA (US)

(72) Inventors: Micheal L. Binns, Atlanta, GA (US); Michelle L. Binns, Atlanta, GA (US)

(73) Assignee: NMN Monday, LLC, Atlanta, GA (US)

( * ) Notice: Subject to any disclaimer, the term of this patent is extended or adjusted under 35 U.S.C. 154(b) by 0 days.

(21) Appl. No.: 17/741,631

(22) Filed: May 11, 2022

(65) Prior Publication Data

US 2022/0264982 A1 Aug. 25, 2022

Related U.S. Application Data

(63) Continuation-in-part of application No. 16/945,782, filed on Jul. 31, 2020, now Pat. No. 11,357,278.

(51) Int. Cl.
*A42B 1/22* (2006.01)

(52) U.S. Cl.
CPC ..... *A42B 1/22* (2013.01)

(58) Field of Classification Search
CPC ..... A42B 1/019; A42B 1/22; A42C 5/02
See application file for complete search history.

(56) References Cited

U.S. PATENT DOCUMENTS 1,243,567 A * 10/1917 Spindler ..... A42B 1/22 2/195.2
1,435,221 A * 11/1922 Fischer ..... A42B 1/22 2/195.4
1,501,654 A * 7/1924 Fischer ..... A42B 1/22 2/195.2
1,525,115 A * 2/1925 Behm ..... A42B 1/22 2/195.3
1,534,421 A * 4/1925 Smith ..... A42B 1/22 D2/885
1,535,841 A * 4/1925 Lupien ..... A42B 1/22 24/DIG. 43
1,559,917 A * 11/1925 Schnebel ..... A42C 5/02 2/182.6

(Continued)

*Primary Examiner* — Heather Mangine
(74) *Attorney, Agent, or Firm* — Parker Poe Adams & Bernstein, LLP; Paul Dietze

(57) ABSTRACT

The invention is an article of headwear that incorporates a hair compression system and adjustment system for compressing one or more sections of a wearer's hair. The headwear may be formed of a crown, a compression system, and an adjustment system. The compression system includes one or more stretchable materials that form the inner layer of the crown. The compression system may compress along a horizontal, diagonal and/or vertical plane of the head of a wearer. The compression system is attached to an adjustment system often at the back of the headwear which can be attached to the crown. The adjustment system allows a user to manually tighten the compression system to a desired pressure to keep the hair of the user compressed while the user wears the headwear. The desired hair compression is capable of being regulated by the adjustment system. When the user is finished wearing the headwear, the adjustment system may be released to allow the user to remove the headwear without undoing the effects of the compression system.

12 Claims, 9 Drawing Sheets

(56) References Cited

U.S. PATENT DOCUMENTS 1,633,457 A * 6/1927 Rosenfeld ..... A42B 1/22 2/195.2
2,078,511 A * 4/1937 Riebold ..... A42B 1/22 D2/886
2,106,570 A * 1/1938 Lipton ..... A42B 1/22 2/171.7
2,243,357 A * 5/1941 Ostolaza ..... A42B 1/22 D2/894
2,356,042 A * 8/1944 Ferber ..... A42B 1/22 D2/885
2,447,850 A * 8/1948 Feldman ..... A42B 1/22 2/195.2
3,631,539 A * 1/1972 Massa ..... A42B 1/22 2/418
4,011,600 A * 3/1977 Malk ..... A42B 1/22 2/183
4,023,212 A * 5/1977 Huffman ..... A42B 1/205 2/171.1
4,481,681 A * 11/1984 Hankin ..... A41D 20/00 2/181
4,630,317 A * 12/1986 Brown ..... A61F 9/045 2/909
5,272,772 A * 12/1993 Hahn ..... A42B 1/22 2/418
5,384,916 A * 1/1995 Portney ..... A42B 1/22 2/418
5,426,789 A * 6/1995 MacLeod ..... A42C 5/02 2/175.1
5,548,845 A * 8/1996 Gallup ..... A42B 1/22 2/195.2
5,553,326 A * 9/1996 Moore ..... A42C 5/02 2/209.13
5,566,395 A * 10/1996 Nebeker ..... A42C 5/02 2/418
5,584,076 A * 12/1996 Armstrong ..... A42B 1/22 2/209.13
5,600,854 A * 2/1997 Henrekin ..... A42B 1/22 24/197
5,603,121 A * 2/1997 Borkovic ..... A42B 1/22 D2/881
5,615,415 A * 4/1997 Beckerman ..... A42B 1/22 2/195.3
5,715,540 A * 2/1998 Cho ..... A42B 1/22 2/195.3
5,887,289 A * 3/1999 Theoret ..... A42B 3/003 2/425
5,915,534 A * 6/1999 May ..... A42C 5/02 2/DIG. 11
5,915,535 A * 6/1999 Henrekin-Jordan .... A41F 9/002 2/183
5,966,742 A * 10/1999 Cunliffe ..... A42C 5/02 2/195.3
6,049,911 A * 4/2000 Bromberg ..... A42B 1/22 2/195.3
6,052,831 A * 4/2000 Park ..... A42C 5/02 2/195.3
6,115,844 A * 9/2000 Cho ..... A42C 5/02 2/175.1
6,119,273 A * 9/2000 Cho ..... A42C 5/02 2/200.1
6,131,202 A * 10/2000 Yan ..... A42C 5/02 2/195.3
6,131,249 A * 10/2000 Suenaga ..... A42B 1/22 24/442
6,167,569 B1 * 1/2001 Conner, IV ..... A42B 1/0182 224/664
6,199,213 B1 * 3/2001 Whang ..... A42B 1/22 2/181
6,237,155 B1 * 5/2001 Seegar ..... A42B 1/22 2/209.12
6,363,537 B1 * 4/2002 Park ..... A42B 1/22 2/181.2
6,446,266 B1 * 9/2002 Park ..... A42B 1/248 2/175.1
6,453,475 B1 * 9/2002 Johnson ..... A42B 1/22 2/209.12
6,467,096 B1 * 10/2002 Coluccio ..... A42B 1/22 2/195.2
6,493,880 B1 * 12/2002 Lo ..... A42B 1/22 2/195.2
6,499,144 B1 * 12/2002 Yan ..... A42B 1/22 2/181.2
6,502,245 B1 * 1/2003 McBride ..... A42C 5/02 2/DIG. 11
6,658,664 B1 * 12/2003 Verhoeven ..... A42B 1/22 2/12
6,748,606 B1 * 6/2004 Silverstein ..... A42B 1/22 2/181.4
6,920,644 B1 * 7/2005 Higgs ..... A42C 5/02 2/195.3
6,941,581 B1 * 9/2005 England ..... A42B 1/22 2/195.2
7,174,572 B1 * 2/2007 Diamond ..... A42C 5/02 2/181
7,814,573 B1 * 10/2010 Greenberg ..... A42B 1/22 2/181
7,882,572 B2 * 2/2011 Wong ..... A42C 5/02 2/181.6
11,357,278 B2 * 6/2022 Binns ..... A42B 1/22
2002/0029404 A1 * 3/2002 Friedman ..... A42B 1/22 2/195.2
2002/0189002 A1 * 12/2002 Porter ..... A42B 1/22 2/195.3
2003/0221234 A1 * 12/2003 Wang ..... A42B 1/22 2/12
2004/0093655 A1 * 5/2004 Cho ..... A42B 1/22 2/209.3
2004/0111784 A1 * 6/2004 Henricksen ..... A41F 19/005 2/125
2004/0187191 A1 * 9/2004 Lee ..... A42B 1/22 2/171
2005/0155135 A1 * 7/2005 Cho ..... A42C 5/02 2/172
2005/0223475 A1 * 10/2005 Turner ..... A42B 1/22 2/209.4
2006/0185060 A1 * 8/2006 Bang ..... A42B 1/0189 2/195.1
2006/0230498 A1 * 10/2006 Yan ..... A42B 1/22 2/209.12
2007/0083982 A1 * 4/2007 Cho ..... A42B 1/22 2/183
2007/0130669 A1 * 6/2007 Rogers ..... A42B 1/22 2/195.1
2007/0226875 A1 * 10/2007 Lee ..... A42B 1/22 2/171
2008/0216210 A1 * 9/2008 Tai ..... A42B 1/248 2/195.3
2009/0064394 A1 * 3/2009 White ..... A42B 1/22 2/175.1
2009/0183300 A1 * 7/2009 Cho ..... A42C 5/02 66/171
2009/0255034 A1 * 10/2009 Little ..... A42B 1/22 2/243.1
2011/0099691 A1 * 5/2011 Duwyn-Zylstra ..... A42B 1/22 2/175.1
2013/0145519 A1 * 6/2013 Cho ..... A42B 1/22 2/183
2014/0026291 A1 * 1/2014 Webster ..... A41B 3/00 2/244
2014/0053317 A1 * 2/2014 Haroutoonian ..... A42B 1/22 2/195.3
2014/0223634 A1 * 8/2014 Maher ..... B32B 5/245 2/200.1
2015/0237943 A1 * 8/2015 Godard ..... A42B 1/22 2/183
2018/0140033 A1 * 5/2018 Thornton ..... A42B 1/0182
2018/0343949 A1 * 12/2018 Cunliffe ..... A42B 1/006
2019/0166941 A1 * 6/2019 Mao ..... A42B 1/02

(56) References Cited

U.S. PATENT DOCUMENTS

| | | | | |
|---|---|---|---|---|
| 2019/0183201 | A1* | 6/2019 | Defino | A42B 1/248 |
| 2020/0128898 | A1* | 4/2020 | Stark | A42B 1/22 |
| 2020/0404999 | A1* | 12/2020 | Burgess | A42B 1/019 |
| 2021/0186135 | A1* | 6/2021 | Shields | A42B 1/008 |
| 2022/0022584 | A1* | 1/2022 | Yim | A42B 1/225 |
| 2022/0031001 | A1* | 2/2022 | Binns | A42B 1/019 |
| 2022/0264982 | A1* | 8/2022 | Binns | A42B 1/22 |

* cited by examiner

COMPRESSION HEADWEAR

CROSS-REFERENCE TO RELATED APPLICATIONS

This application is a continuation-in-part of application Ser. No. 16/945,782, filed Jul. 31, 2020, allowed.

BACKGROUND OF THE INVENTION

Field of the Invention

The present invention relates to headwear. The invention concerns, more particularly, headwear, such as a visor, baseball cap, athletic cap or formal hat, having a hair compression system and an adjustment system for compressing and securing one or more sections of a wearer's hair.

Description of Background Art

In today's society, feeling and looking good are important parts of human culture. As a part of this pursuit, fitness is one important aspect of the lives of individuals. Equally important to physical exercise is an outward fashion appearance, which has given rise to the popularity of fitness apparel or "athleisure." This fitness apparel allows for enhanced performance benefits and comfort while keeping a user aesthetically pleasing. Fitness fashion, however, has not properly adapted to maintaining the hair of a user during fitness activities or casual wear. In many cases, an individual must choose between their physical fitness or hair appearance.

Currently, the fitness industry offers fitness coverings such as hats, visors, and headbands that allow for sun protection and moisture wicking properties. These offerings may also include an additional fashion benefit in that they are visually appealing. In some instances, hats, visors, and headbands may contain a sweatband to capture and dispel sweat. These advantages are beneficial, but do not protect the appearance of the hair of a user or protect the hair from physical damage. Indeed, under typical circumstances, the end result to a user's hair is a disheveled or messy hair appearance commonly referred to as "hat hair."

In contrast, if protecting the hair is of import, head coverings such as head wraps, scarves, head coverings, durags, and bandanas may be utilized. However, they do not offer the benefit of shading, weather protection, moisture wicking capabilities or fashion-forward advantages of a fitness covering. Because of these limitations, in many cases, head coverings are utilized along with a fitness covering. In these instances, the wearer often experiences increased heat from the combination of the two products, which results in increased perspiration, which damages hair thus eliminating any benefit brought on by the combination of the head covering and fitness covering.

Even outside of the fitness aspect, the intersection of fashion and hair care are often at odds. When wearing a dress hat, e.g., fedora, homburg, bowler, cowboy, cloche, flapper, knit hat, or beanie, the hair is often disheveled upon removal of the hat. This creates a problem when, for example, a wearer must remove the fashion accessory at a formal event, work, or other occasion. The resulting disheveled hair is often at odds with an otherwise well-kept appearance. While the use of a head covering may also be utilized with a dress hat, added heat and bulk create unwanted consequences such as increased heat and/or perspiration, which may distort a hair style or damage hair.

Several other applicants have filed for patent protection over a liner for reducing moisture in fitness coverings by employing a liner into headwear. Such disclosures include U.S. Patent Publication Numbers 2007/0006364 to Brewer; 2010/0107307 to Lee; and 2020/0046053 to Weems. These publications seek to prevent or minimize sweat. None of the foregoing publications, however, address the problems overcome by the present invention.

In most instances, however, headwear innovation focuses on sizing or fit of the headwear. Specifically, the sizing of headwear improves either in an adjustable manner or of fixed sizing to secure fit of the hat to a wearer's head. For example, when considering an adjustable fit, a common style of adjustment system is disclosed in U.S. Pat. No. 5,272,772 to Hahn. In Hahn, a rear portion of the baseball cap includes a cut-out area having two overlapping straps that extend from opposite sides of the cut-out area. One of the straps includes a plurality of protrusions and the other strap includes a plurality of corresponding apertures. By varying the protrusions that are received by specific apertures, the circumference of the baseball cap is adjusted, thus tightening the hat. There are also fixed hats that provide for an adjustment system. In these instances, U.S. Pat. No. 5,966,742 to Cunliffe; U.S. Pat. No. 6,199,213 to Whang; U.S. Pat. No. 6,920,644 to Higgs; and U.S. Pat. No. 7,278,173 to Turner each disclose adjustable baseball caps that incorporate a stretchable material to accommodate the head size of a wearer. Each of these patents disclose varying the bottom of the crown to vary the effective diameter of a headband in the crown, thus tightening the cap. None of the foregoing patents, however, address the problems overcome by the present invention.

SUMMARY OF THE INVENTION

The following presents a simplified summary of the invention in order to provide a basic understanding of some aspects of the invention. This summary is not an extensive overview of the invention and is not intended to be limiting in scope nor exhaustive in breadth. It is not intended to identify key or critical elements of the invention or to delineate the scope of the invention; its sole purpose is to present concepts of the invention in a simplified form as a prelude to the more detailed description that is subsequently presented.

The present invention is an article of headwear that incorporates a hair compression system for smoothly compressing the hair of a wearer while wearing the headwear to prevent the disheveling or tangling of the wearer's hair. The compression system may compress along a periphery, middle and/or vertical plane of the head of a wearer. In one embodiment, the compression system is primarily formed of a first stretchable material around the circumference of a wearer's head attached to the inside of the headwear and extends around an interior circumference of the headwear. The first stretchable material is attached to the headwear in a manner to allow the first stretchable material to directly contact the hair and be compressed around the circumference of the hair to a tightness specifically selected by the wearer to keep the hair in place without tightening the headwear. In another embodiment, the compression system also includes a second stretchable material that is attached to the headwear in a manner to allow the second stretchable material to directly contact the hair and be compressed around the side of the scalp to a tightness specifically selected by the wearer to keep the hair in place without tightening the headwear. In yet another embodiment, the compression system also includes a third stretchable material that is attached to the headwear in a manner to allow the third stretchable material to directly contact the hair and be compressed about a vertical portion, e.g., over the top of the head, of the hair of a wearer to a tightness specifically selected by the wearer to keep the hair compressed without tightening the headwear.

The compression system is attached to an adjustment system, which allows the user to selectively tighten the first stretchable material, second stretchable material and/or third stretchable material of the compression system. The adjustment system may be made up of a stretchable elastic that pulls the ends of the first stretchable material, second stretchable material and/or third stretchable material of the compression system together to allow the user to selectively tighten the compression system. The headwear may be a visor hat that includes the compression system on the inside of at least a portion of the visor. In another embodiment, the headwear is a baseball-style cap. The crown of the cap is formed of a plurality of sides, with the compression system being affixed to at least one of the sides of the crown. The compression system may be attached to the headwear using a guide. The headwear may also include dress hats.

In certain embodiments of the invention, the invention is an article of headwear capable of compressing at least a portion of the head of a wearer. Specifically, the headwear comprises a crown, a compression system that is capable of smoothly compressing at least a portion of the head of the wearer, and where the compression system comprises a first stretchable material. The headwear also includes an adjustment system for adjusting the compression system. The article of headwear may include a first stretchable material that compresses in a direction of the circumference of the headwear. The first stretchable material of the article of headwear may be a textile. The adjustment system of the article of headwear may comprise a fastening means and a tightening means. The article of headwear of may also incorporate a sweatband that can be attached to the crown of the headwear and the compression system. For example, the sweatband may be positioned between the crown and the compression system so that the sweat from the head of a wearer is dispelled through the compression system and onto the sweatband. This also increases the likelihood that the sweat will be trapped on the sweatband and not transferred to the outer surface of the crown, which may cause sweat stains. The use of a sweatband may also reduce the transfer of sweat back to the compression system and/or the hair of a wearer. The compression system of the article of headwear of the present invention may further comprise a second stretchable material. The compression system of the article of headwear of the present invention may further comprise a third stretchable material. The compression system of the article of headwear of the present invention may further comprise a second stretchable material and a third stretchable material.

In further embodiments, the present invention may be a cap capable of compressing at least a portion of the head of a wearer. The cap of the present invention may comprise a compression system for compressing at least a portion of the head of the wearer. The compression system may also comprise a first stretchable material and a second stretchable material. The cap of the present invention may also include an adjustment system attached to the compression system. The first stretchable material of the compression system may stretch in direction of a circumference of the cap. The compression system of the cap may also include a second stretchable material that stretches in a direction diagonal around sides of the head of the wearer. The adjustment system of the cap may comprise a fastening means. The adjustment system may further comprise a tightening means.

In still other embodiments, a cap is contemplated that is capable of being selectively compressed by a wearer around head of the wearer. The cap comprises a compression system for compressing at least a portion of the head of the wearer. The compression system comprises a first stretchable material. The cap also includes an adjustment system attached to the compression system, wherein the adjustment system comprises a fastening means and a tightening means. The adjustment system of the cap allows the wearer to selectively tighten the compression system to compress at least a portion of the hair, head or scalp of the wearer. The compression system of the cap may further comprise a second stretchable material and/or a third stretchable material. The adjustment system of the cap may comprise a fastening means and/or a tightening means. The cap of the present invention may also include a sweatband.

The advantages and features of novelty characterizing the present invention are pointed out-with particularity in the appended claims. Further features of the present invention will be apparent from the description that follows. To gain an improved understanding of the advantages and features of novelty, however, reference may be made to the following descriptive matter and accompanying drawings that describe and illustrate various embodiments and concepts related to the invention. After review, such features may, in part, be obvious from the description or may be learned by practice of the invention. It is to be understood that both the foregoing general description and the following detailed description are exemplary and explanatory only and are not restrictive of the invention, as claimed.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
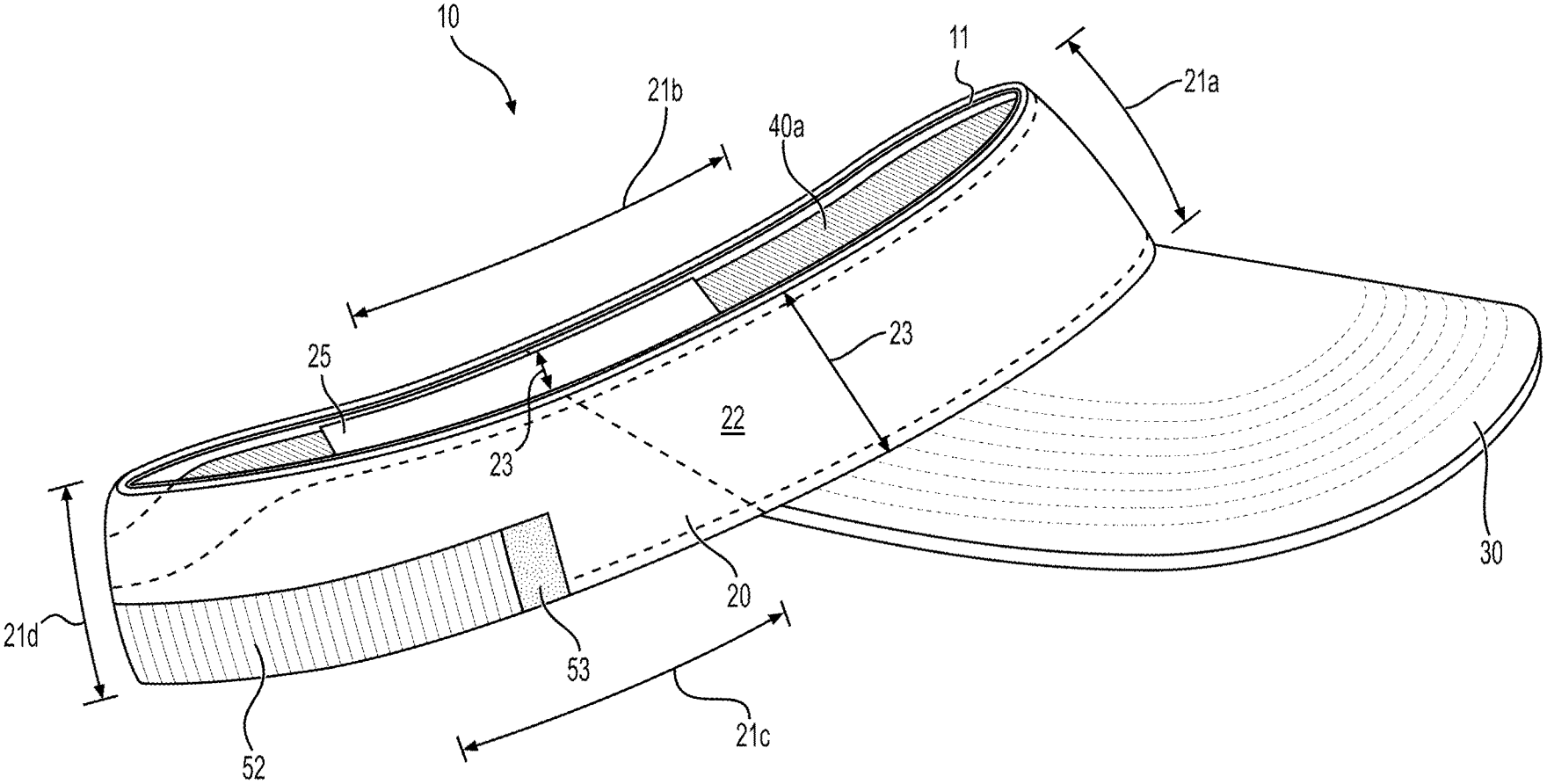
FIG. 1 is a first perspective view of an article of headwear, specifically a visor, having a crown and a brim in accordance with the present invention.

Having generally summarized the invention disclosure above, a further understanding can be obtained by reference to certain specific examples illustrated below which are provided for purposes of illustration only and are not intended to be all inclusive or limiting unless otherwise specified. Accordingly, term or phrases such as "for example" or "e.g." and the like, even if they are not coupled with a modifier such as "without limitation" or the like, are not intended to be limiting of the disclosure of the invention.

Reference now will be made in detail to embodiments and examples of the present invention. The particular components and amounts thereof recited in these examples, as well as other conditions and details, should not be construed to unduly limit this invention.

The following discussion and accompanying figures disclose an article of headwear 10 with a crown 20 and a brim 30 and include a compression system 40*a-c* and an adjustment system 50 in accordance with the present invention. Headwear 10 is disclosed as having the structure of a visor or baseball-style cap. The concepts and features of headwear 10 that are disclosed in the following discussion may, however, be applied to a wide range of headwear types, including a bonnet, knit hat, boater, beret, cowboy hat, fedora, fez, panama, sombrero, southwester, homburg, bowler, cloche, flapper or beanie, for example. Accordingly, the present invention is not limited to visors and baseball-style caps, but may be applied to a wide range of headwear.

Headwear 10 is depicted in FIGS. 1-9 and includes two principal elements, a crown 20 and a brim 30. Referring to FIGS. 1-9, crown 20 forms a general covering for a head of an individual, and brim 30 extends outward in a generally horizontal direction from crown 20 to shade the face and eyes of an individual. Brim 30, however, is not required to be included on the headwear 10. The materials forming crown 20 generally extend around a circumference of the head. Headwear 10 incorporates a compression system 40*a-c* that allows for compression of the hair of an individual and an adjustment system 50 that accommodates individual tightening of the compression system 40*a-c*. While the present invention is discussed with respect to compression of the hair of a wearer, it is apparent that the present invention may have benefits to a wearer who does not have a full head of hair or any hair. Therefore, the present invention may be used to compress the scalp or head of a wearer.

Crown 20 includes a plurality of sides that are typically attached together along abutting sides or assembled in one or more pieces. As depicted in FIGS. 1-9, crown 20 includes four sides 21*a*-21*d*. More specifically, crown 20 includes a front side 21*a* that is located adjacent to brim 30, two sides that are located on a left side 21*b* and a right side 21*c* of headwear 10, respectively, and one rear side 21*d* that is located in a rear area of headwear 10. The various sides 21*a-d* define an exterior surface 22 and an opposite interior surface 23. The sides 21*a-d* may be any material used to make headwear 10 now known or thought of in the future, including, but not limited to, one or more of the following: polyester, nylon, cotton, wool, linen, velour, velvet, microfiber, silk, satin, or other similar fabric. Sides 21*a-d* are formed of varying materials and can be deformed in the presence of a force to accommodate individuals with various head dimensions. Crown 20 may be open at the top, similar to a visor as depicted in FIGS. 1-4, closed as depicted in FIGS. 5-9, or partially open in one or more of the sides 21*a-d*. For example, the headwear 10 may have no rear side 21*d* to allow the hair of a wearer to exit and open panels of the headwear in the form of a ponytail, afro, or otherwise. In the event of a partially open hat, it may have closed portions along one or more of the sides 21*a-d*. The crown 20 of the headwear 10 as discussed herein may be assembled through various methods to manufacture headwear 10. A liner material, such as a textile, may also be located on interior surface 23 and may also be adjacent to front side 21*a* to reinforce the front area of crown 20 and ensure an aesthetically rounded structure in the front area. A sweatband 11 may be incorporated into the crown 20, which can be formed of a knitted material with one or two directions of stretch. The material forming the sweatband 11 may also be selected to wick perspiration and other moisture away from the head. The interior surface 23 of the crown 20 includes a compression system 40*a-c*.

The compression system 40*a-c* will now be discussed in greater detail. The compression system 40*a-c* is attached on an interior surface 23 of the crown 20. The compression system 40*a-c* can be made of any textile or fabric capable of restraining and smoothing hair. The compression system 40*a-c* is a stretchable material. As utilized herein, the term stretchable material refers to a material property rather than a particular type of material. More specifically, the material property is the ability to substantially return to an original size and shape following a deformation. After being stretched to a reasonable degree, therefore, the compression system 40*a-c* is capable of substantially returning to an unstretched configuration. The compression system 40*a-c* can comprise a natural fabric, a synthetic fabric, or a blend thereof. The compression system 40*a-c* may be made of any material with the ability to substantially return to an original size and shape following a deformation. In addition, in order to enhance the air permeability and overall comfort of the compression system 40*a-c*, it may be made of a single or blend of elastic, high-performance material, spandex, nylon, microfiber, cotton, polyester, silk, satin, or other similar fabric and may also include a textile that incorporates elastomeric fibers, such as elastane, which is manufactured under the LYCRA™ trademark by E.I. duPont de Nemours and Company.

In some embodiments, the compression system 40*a-c* comprises spandex. In some embodiments, the compression system 40*a-c* comprises a spandex blend. In some embodiments, the compression system 40*a-c* comprises a polyester/spandex blend. In some embodiments, the compression system 40*a-c* comprises nylon. In some embodiments, the compression system 40*a-c* comprises 75% or less of spandex (e.g., 70% or less, 60% or less, 50% or less, 40% or less, 35% or less, 30% or less, 25% or less, 20% or less, 15% or less, or 10% or less). In some embodiments, the compression system 40*a-c* comprises 5% or greater of spandex (e.g., 10% or greater, 15% or greater, 20% or greater, 25% or greater, 30% or greater, 35% or greater, 40% or greater, 50% or greater, or 60% or greater). In some embodiments, the compression system 40*a-c* comprises 90% or less of nylon (e.g., 85% or less, 80% or less, 75% or less, 70% or less, 60% or less, 50% or less, 40% or less, 35% or less, 30% or less, 25% or less, 20% or less, 15% or less, or 10% or less). In some embodiments, the compression system 40*a-c* comprises 5% or greater of nylon (e.g., 10% or greater, 15% or greater, 20% or greater, 25% or greater, 30% or greater, 35% or greater, 40% or greater, 50% or greater, 60% or greater, 65% or greater, 70% or greater, 75% or greater, 80% or greater, or 85% or greater). In some embodiments, the compression system 40*a-c* comprises 40% or less of polyester (e.g., 30% or less, 25% or less, 20% or less, 15% or less, or 10% or less). In some embodiments, the compression system 40*a-c* comprises 5% or greater of polyester (e.g., 10% or greater, 15% or greater, 20% or greater, 25% or greater, 30% or greater, or 35% or greater). In some embodiments, the compression system 40*a-c* comprises 40% or less of silk (e.g., 30% or less, 25% or less, 20% or less, 15% or less, or 10% or less). In some embodiments, the compression system 40*a-c* comprises 5% or greater of silk (e.g., 10% or greater, 15% or greater, 20% or greater, 25% or greater, 30% or greater, or 35% or greater). In some embodiments, the compression system 40*a-c* comprises 40% or less of satin (e.g., 30% or less, 25% or less, 20% or less, 15% or less, or 10% or less). In some embodiments, the compression system 40*a-c* comprises 5% or greater of satin (e.g., 10% or greater, 15% or greater, 20% or greater, 25% or greater, 30% or greater, or 35% or greater). In some embodiments, the compression system 40*a-c* comprises 40% or less of LYCRA™ (e.g., 30% or less, 25% or less, 20% or less, 15% or less, or 10% or less). In some embodiments, the compression system 40*a-c* comprises 5% or greater of LYCRA™ (e.g., 10% or greater, 15% or greater, 20% or greater, 25% or greater, 30% or greater, or 35% or greater). In some embodiments, the compression system 40*a-c* comprises a polyester/LYCRA™ blend. In some embodiments, the compression system 40*a-c* comprises a polyester/satin blend. In some embodiments, the compression system 40*a-c* comprises a polyester/silk blend. In some embodiments, the compression system 40*a-c* comprises a silk/satin blend. In some embodiments, the compression system 40*a-c* comprises modal, rayon, and spandex. In some embodiments, the compression system 40*a-c* comprises cotton. In some embodiments, the compression system 40*a-c* comprises a cotton blend. In some embodiments, the compression system 40*a-c* comprises microfiber.

The compression system 40*a-c* can be made, for instance, by circular knitting, warp knitting, or any weaving or knitting technique known in the art. In some embodiments, the compression system 40*a-c* has varied properties. The compression system 40*a-c* can be attached to the crown 20 of the headwear 10 by any means capable of attaching fabric layers together. In some embodiments, the compression system 40*a-c* is attached to the crown 20 of the headwear 10 by sewing, adhering, zipping, buttoning, snapping, heat sealing, welding, gluing, bonding, laser cutting, and combinations thereof.

The compression system 40*a-c* may include a first stretchable material 40*a*, a second stretchable material 40*b* and/or a third stretchable material 40*c* that are incorporated into the crown 20 of the headwear 10. The first stretchable material 40*a*, the second stretchable material 40*b* and the third stretchable material 40*c* may be any stretchable material with the ability to substantially return to an original size and shape following a deformation. Accordingly, sheets of elastomeric polymer materials are suitable. In order to enhance the air permeability and overall comfort of the first stretchable material 40*a*, the second stretchable material 40*b* and the third stretchable material 40*c*, may be made of a single or blends of elastic, high-performance, microfiber, cotton, polyester, silk, satin, or other similar fabric. Specifically, the first stretchable material 40*a*, the second stretchable material 40*b* and the third stretchable material 40*c* can be made of any material identified above for the compression system 40*a-c*.

In some embodiments, the first stretchable material 40*a*, the second stretchable material 40*b* and/or the third stretchable material 40*c* comprise spandex. In some embodiments, the first stretchable material 40*a*, the second stretchable material 40*b* and/or the third stretchable material 40*c* comprise a spandex blend. In some embodiments, the first stretchable material 40*a*, the second stretchable material 40*b* and/or the third stretchable material 40*c* comprise a polyester/spandex blend. In some embodiments, the first stretchable material 40*a*, the second stretchable material 40*b* and/or the third stretchable material 40*c* comprise nylon.

In some embodiments, the first stretchable material 40*a*, the second stretchable material 40*b* and/or the third stretchable material 40*c* comprise 75% or less of spandex (e.g., 70% or less, 60% or less, 50% or less, 40% or less, 35% or less, 30% or less, 25% or less, 20% or less, 15% or less, or 10% or less). In some embodiments, the first stretchable material 40*a*, the second stretchable material 40*b* and/or the third stretchable material 40*c* comprise 5% or greater of spandex (e.g., 10% or greater, 15% or greater, 20% or greater, 25% or greater, 30% or greater, 35% or greater, 40% or greater, 50% or greater, or 60% or greater). In some embodiments, the first stretchable material 40*a*, the second stretchable material 40*b* and/or the third stretchable material 40*c* comprise 90% or less of nylon (e.g., 85% or less, 80% or less, 75% or less, 70% or less, 60% or less, 50% or less, 40% or less, 35% or less, 30% or less, 25% or less, 20% or less, 15% or less, or 10% or less). In some embodiments, the first stretchable material 40*a*, the second stretchable material 40*b* and/or the third stretchable material 40*c* comprise 5% or greater of nylon (e.g., 10% or greater, 15% or greater, 20% or greater, 25% or greater, 30% or greater, 35% or greater, 40% or greater, 50% or greater, 60% or greater, 65% or greater, 70% or greater, 75% or greater, 80% or greater, or 85% or greater). In some embodiments, the first stretchable material 40*a*, the second stretchable material 40*b* and/or the third stretchable material 40*c* comprise 40% or less of polyester (e.g., 30% or less, 25% or less, 20% or less, 15% or less, or 10% or less). In some embodiments, the first stretchable material 40*a*, the second stretchable material 40*b* and/or the third stretchable material 40*c* comprise 5% or greater of polyester (e.g., 10% or greater, 15% or greater, 20% or greater, 25% or greater, 30% or greater, or 35% or greater). In some embodiments, the first stretchable material 40*a*, the second stretchable material 40*b* and/or the third stretchable material 40*c* comprise 40% or less of silk (e.g., 30% or less, 25% or less, 20% or less, 15% or less, or 10% or less). In some embodiments, the first stretchable material 40*a*, the second stretchable material 40*b* and/or the third stretchable material 40*c* comprise 5% or greater of silk (e.g., 10% or greater, 15% or greater, 20% or greater, 25% or greater, 30% or greater, or 35% or greater). In some embodiments, the first stretchable material 40*a*, the second stretchable material 40*b* and/or the third stretchable material 40*c* comprise 40% or less of satin (e.g., 30% or less, 25% or less, 20% or less, 15% or less, or 10% or less). In some embodiments, the first stretchable material 40*a*, the second stretchable material 40*b* and/or the third stretchable material 40*c* comprise 5% or greater of satin (e.g., 10% or greater, 15% or greater, 20% or greater, 25% or greater, 30% or greater, or 35% or greater). In some embodiments, the first stretchable material 40*a*, the second stretchable material 40*b* and/or the third stretchable material 40*c* comprise 40% or less of LYCRA™ (e.g., 30% or less, 25% or less, 20% or less, 15% or less, or 10% or less). In some embodiments, the first stretchable material 40*a*, the second stretchable material 40*b* and/or the third stretchable material 40*c* comprise 5% or greater of LYCRA™ (e.g., 10% or greater, 15% or greater, 20% or greater, 25% or greater, 30% or greater, or 35% or greater).

In some embodiments, the first stretchable material 40*a*, the second stretchable material 40*b* and/or the third stretchable material 40*c* comprise a polyester/LYCRA™ blend. In some embodiments, the first stretchable material 40*a*, the second stretchable material 40*b* and/or the third stretchable material 40*c* comprise a polyester/satin blend. In some embodiments, the first stretchable material 40*a*, the second stretchable material 40*b* and/or the third stretchable material 40*c* comprise a polyester/silk blend. In some embodiments, the first stretchable material 40*a*, the second stretchable material 40*b* and/or the third stretchable material 40*c* comprise a silk/satin blend. In some embodiments, the first stretchable material 40*a*, the second stretchable material 40*b* and/or the third stretchable material 40*c* comprise modal, rayon, and spandex. In some embodiments, the first stretchable material 40*a*, the second stretchable material 40*b* and/or the third stretchable material 40*c* comprise cotton. In some embodiments, the first stretchable material 40*a*, the second stretchable material 40*b* and/or the third stretchable material 40*c* comprise a cotton blend. In some embodiments, the first stretchable material 40*a*, the second stretchable material 40*b* and/or the third stretchable material 40*c* comprise microfiber. The first stretchable material 40*a*, the second stretchable material 40*b* and the third stretchable material 40*c* can be made, for instance, by circular knitting, warp knitting, or any weaving or knitting technique known in the art. In some embodiments, the first stretchable material 40*a*, the second stretchable material 40*b* and the third stretchable material 40*c* have varied properties.

Figure 2:
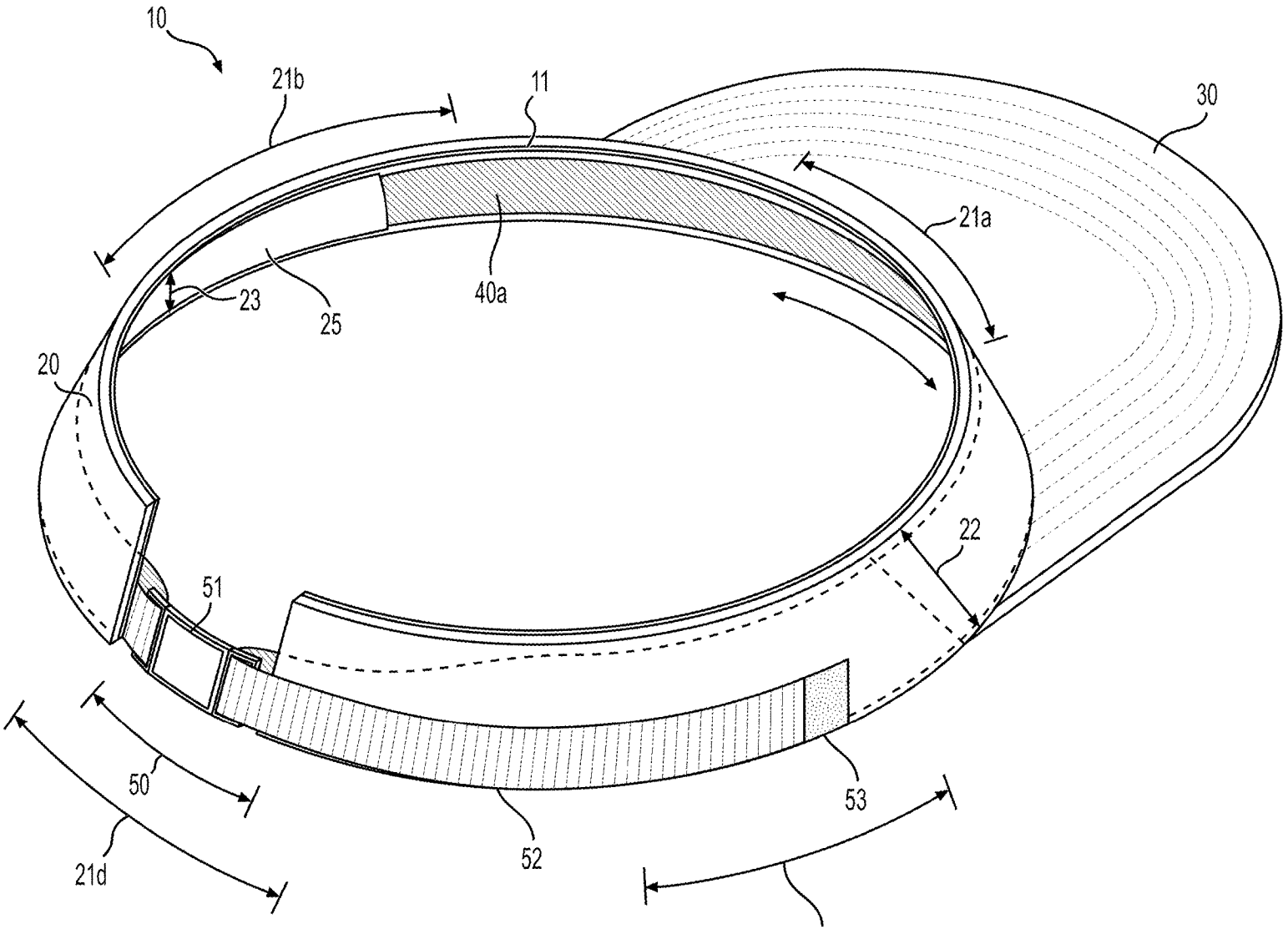
FIG. 2 is a second perspective view of the headwear, specifically a visor, that depicts a back area of the headwear.
Figure 3:
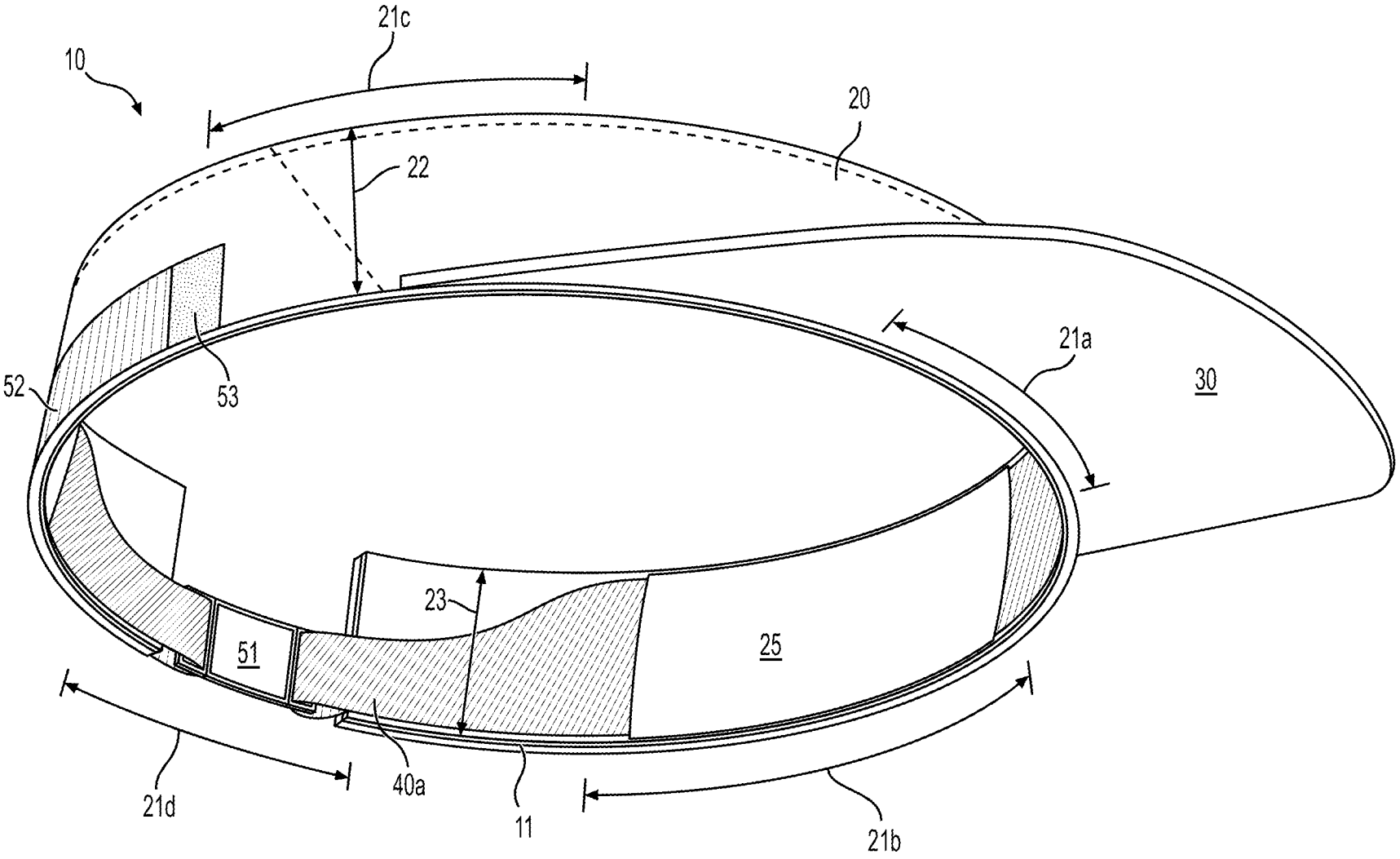
FIG. 3 is a third perspective view of the headwear, specifically a visor cap, that depicts an under area of the headwear.

The first stretchable material 40*a* will now be discussed in greater detail. Referring to FIGS. 1-3, the first stretchable material 40*a* of the compression system 40*a-c* is made of one or more pieces. Preferably, the first stretchable material 40*a* is a single continuous piece. However, the first stretchable material 40*a* may not be one piece, but two or more pieces functioning as a single piece of material. The first stretchable material 40*a* can range in width of from about 0.5 cm to about 10 cm or more. Preferably, the width of the first stretchable material 40*a* is within a range of from about 1.5 cm to about 8 cm. More preferably, the width of the first stretchable material 40*a* is within a range of from about 3 cm to about 6 cm. The increased width of the first stretchable material 40*a* allows increased surface area to contact with the hair in order to smooth and compress the hair of a wearer while wearing the headwear 10. The first stretchable material 40*a* can range in length around the perimeter of the crown 20 of from about 40 cm to about 100 cm or more. Preferably, the length of the first stretchable material 40*a* is within a range of from about 50 cm to about 80 cm. More preferably, the length of the first stretchable material 40*a* is within a range of from about 55 cm to about 75 cm. The length of the first stretchable material 40*a* may vary to accommodate the specific type or size of headwear 10. Depending on the headwear 10, the width of the first stretchable material 40*a* may stay uniform throughout. Alternatively, the width of the first stretchable material 40*a* may fluctuate in width along the crown 20 of the headwear 10.

The first stretchable material 40*a* of the compression system 40*a-c* is attached to the interior surface 23 of the front side 21*a* of the crown 20. The first stretchable material 40*a* may be attached horizontally at one or more points along the interior surface 23 of the front side 21*a* of the crown 20. The first stretchable material 40*a* may be attached at a bottom portion, a middle portion or a top portion of the interior surface 23 of a front side 21*a* of the crown 20. Preferably, the first stretchable material 40*a* is attached along the lowest edge of the interior surface 23 of the front side 21*a* of the crown 20 near the brim 30. The first stretchable material 40*a* may also be attached vertically to the interior surface 23 of the front side 21*a* of the crown 20 at one or more location in order to secure the first stretchable material 40*a* to the headwear 10. The first stretchable material 40*a* may be attached to the left side 21*b* and the right side 21*c* of the interior surface 23 of the headwear 10. The first stretchable material 40*a* may be continuously attached or partially attached to the left side 21*b* and the right side 21*c* or only partially attached to the left side 21*b* and the right side 21*c*. The first stretchable material 40*a* may also be attached at one or more points to the left side 21*b* and one or more points to the right side 21*c* of the interior surface 23 of the headwear 10. For example, in one embodiment, the first stretchable material 40*a* may be attached to a portion of the left side 21*b* near the rear side 21*d* and the right side 21*c* near the rear side 21*d*. A person of ordinary skill in the art can determine whether the first stretchable material 40*a* needs to be attached to the left side 21*b* or the right side 21*c* based on the type of headwear 10. The first stretchable material 40*a* may follow along the left side 21*b* and the right side 21*c* of the headwear 10 using a guide 25.

In another embodiment, the first stretchable material 40*a* is inserted into a guide 25, which directs the first stretchable material 40*a* towards the rear side 21*d* along the left side 21*b* and into a guide 25, which directs the first stretchable material 40*a* along the right side 21*c* of the headwear 10. The guide 25 may be made of any material identified above for making the compression system 40*a-c*. If a guide 25 is used in an embodiment, the first stretchable material 40*a* enters the guide 25 along the left side 21*b* and a guide 25 along the right side 21*c* and exits the guide 25 at a rear portion of the headwear 10 before the rear side 21*d*. In another embodiment, the first stretchable material 40*a* enters the guide 25 along the left side 21*b* and a guide 25 along the right side 21*c* and exists the guide 25 on the rear side 21*d*. Depending on the headwear 10, the first stretchable material 40*a* may be attached to the left side 21*b* near the rear side 21*d*, even if a guide 25 is used. In yet another embodiment, a more than one guide 25 may be used along a side 21*a-d* of the headwear 10 to direct the first stretchable material 40*a* along the interior surface 23 of the crown 20. The present invention may also use one or more guide 25 on the front side 21*a* and/or the rear side 21*d* of the headwear 10.

The second stretchable material 40*b* will now be discussed in greater detail. The compression system 40*a-c* may also include a second stretchable material 40*b*. The second stretchable material 40*b* may be one continuous piece or two or more pieces functioning as a uniform material. The second stretchable material 40*b* is adjacent to the first stretchable material 40*a* and runs along a middle portion of the left side 21*b* and a middle portion of the right side 21*c* of the crown 20. The second stretchable material 40*b* may be connected, completely or partially to the first stretchable material 40*a*, but connection is not required. The second stretchable material 40*b* can be attached to the first stretchable material 40*a* by any means capable of attaching fabric layers together. The second stretchable material 40*b* can range in width starting from the front side 21*a* of the crown 20 of from about 0.5 cm to about 20 cm. Preferably, the width of the second stretchable material 40*b* ranges from about 2 cm to about 10 cm. More preferably, the width of the second stretchable material 40*b* ranges from about 5 cm to about 8 cm. The increased width of the second stretchable material 40*b* allows increased surface area to contact with the hair in order to compress the hair while wearing the headwear 10. The second stretchable material 40*b* can range in length around the crown 20 of from about 5 cm to about 70 cm or more. Preferably, the length of the second stretchable material 40*b* is within a range of from about 10 cm to about 50 cm. More preferably, the length of the second stretchable material 40*b* is within a range of from about 15 cm to about 25 cm. The length of the second stretchable material 40*b* may vary to accommodate the specific type or size of headwear 10. Depending on the headwear 10, the width of the second stretchable material 40*b* may stay uniform throughout. Alternatively, the width of the second stretchable material 40*b* may fluctuate in along the length of the headwear 10.

Figure 6:
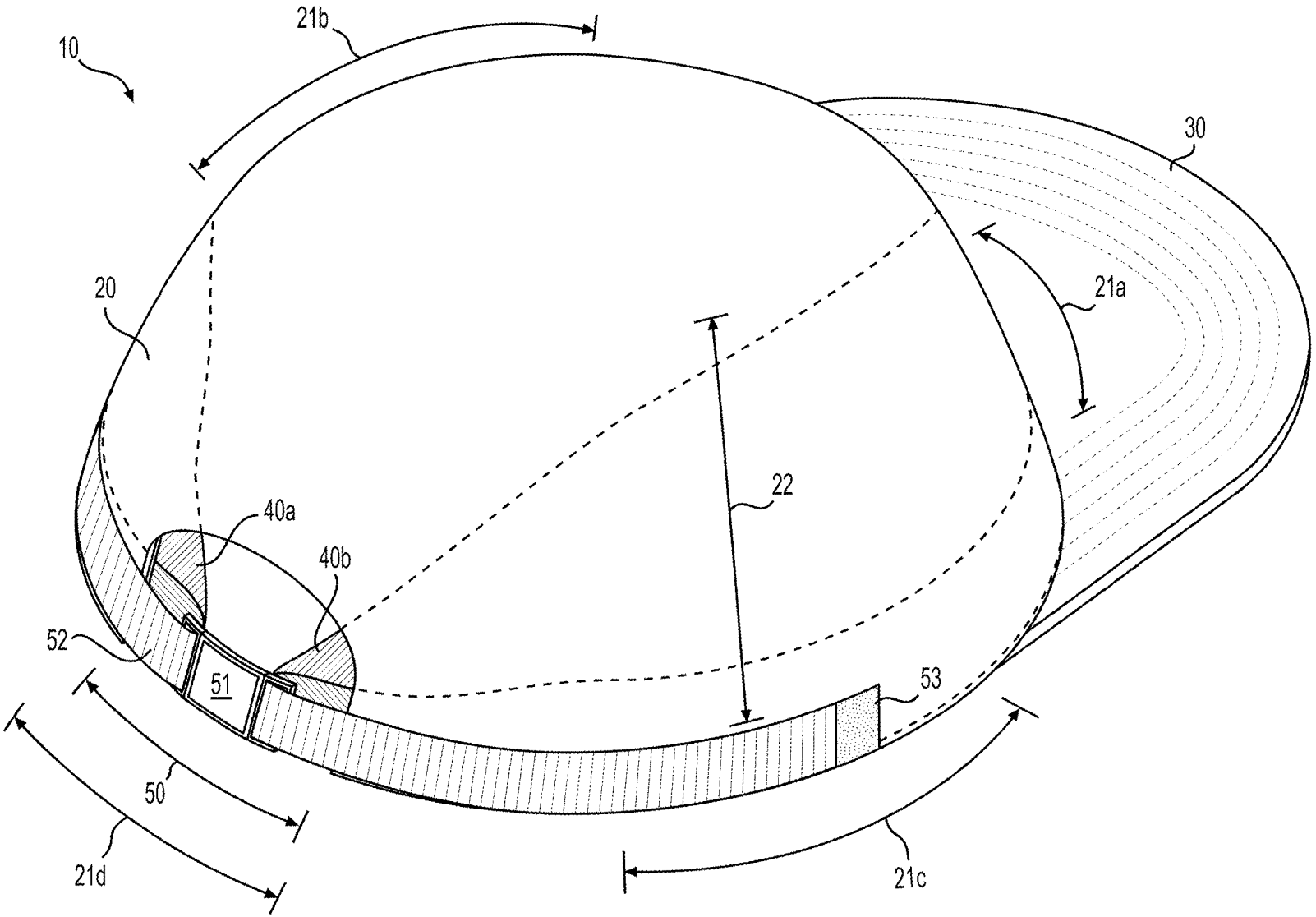
FIG. 6 is a second perspective view of another embodiment of the headwear, specifically a baseball-style cap, that depicts a back area of the headwear.
Figure 7:
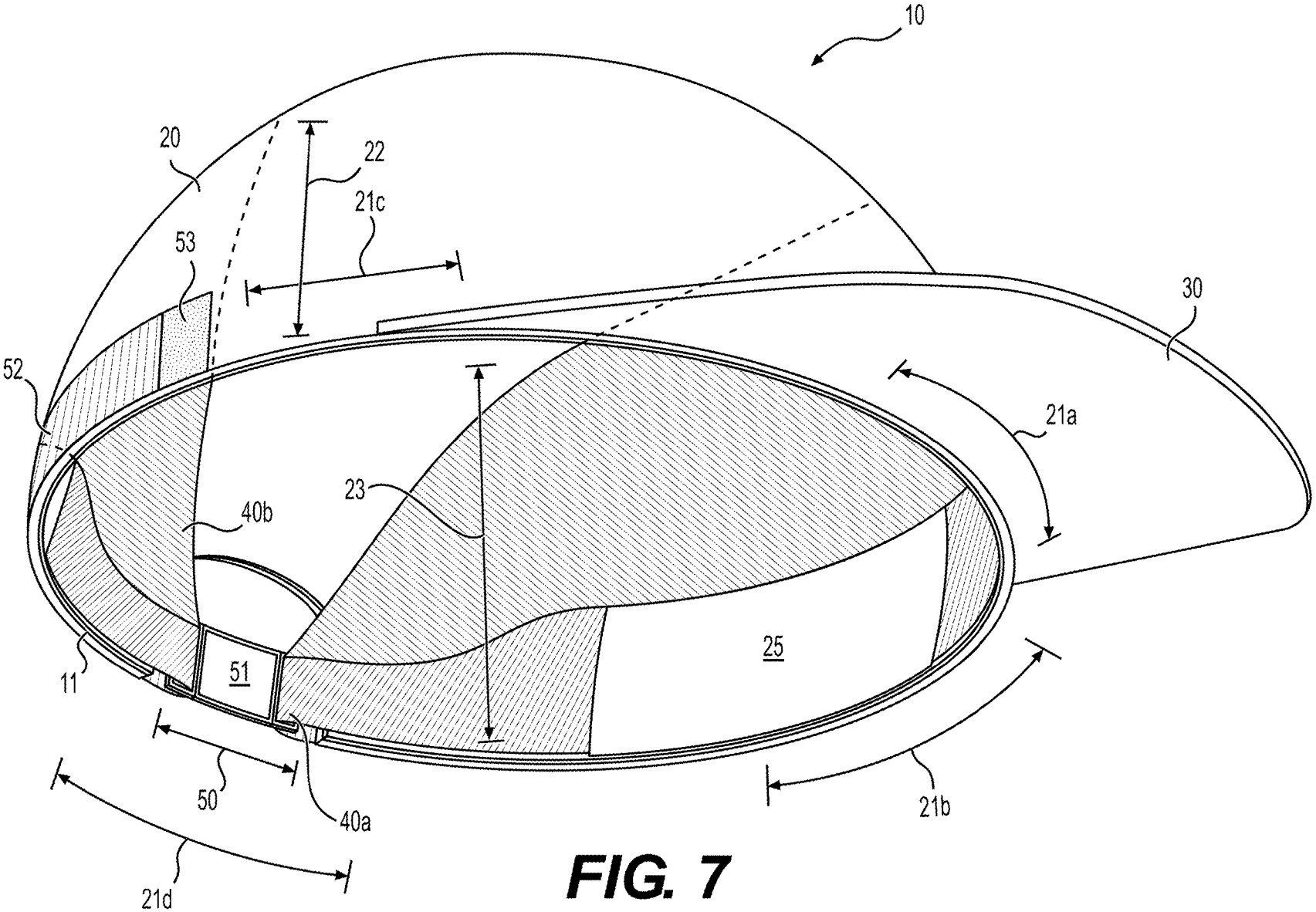
FIG. 7 is a third perspective view of another embodiment of the headwear, specifically a baseball-style cap, that depicts an under area of the headwear.

Referring to FIGS. 6 and 7, the second stretchable material 40*b* of the compression system 40*a-c* is attached to the interior surface 23 of the front side 21*a* of the crown 20. The second stretchable material 40*b* may be attached horizontally at one or more points along the interior surface 23 of the front side 21*a* of the crown 20. The second stretchable material 40*b* may be attached at a bottom portion, a middle portion or a top portion of the interior surface 23 of a front side 21*a* of the crown 20. Preferably, the second stretchable material 40*b* is attached along the middle portion of the interior surface 23 of the front side 21*a* of the crown 20. The second stretchable material 40*b* may also be attached vertically to the interior surface 23 of the front side 21*a* of the crown 20 at one or more location in order to secure the second stretchable material 40*b* to the headwear 10. The second stretchable material 40*b* may be attached to the left side 21*b* and the right side 21*c* of the interior surface 23 of the headwear 10 along the middle portion of the left side 21*b* and the middle portion of the right side 21*c* of the crown 20. The second stretchable material 40*b* may be continuously attached or partially attached to the left side 21*b* and the right side 21*c* or only partially attached to the left side 21*b* and the right side 21*c*. The second stretchable material 40*b* may also be attached at one or more points to the left side 21*b* and one or more points to the right side 21*c* of the interior surface 23 of the headwear 10. For example, in one embodiment, the second stretchable material 40*b* may be attached to a portion of the left side 21*b* near the rear side 21*d* and the right side 21*c* near the rear side 21*d*. A person of ordinary skill in the art can determine whether the second stretchable material 40*b* needs to be attached to the left side 21*b* or the right side 21*c* as well as determine the frequency of attachment based on the type of headwear 10. The second stretchable material 40*b* may follow along the left side 21*b* and the right side 21*c* of the headwear 10 using at least one guide 25.

In one embodiment, the second stretchable material 40*b* is inserted into a guide 25, which directs the second stretchable material 40*b* towards the rear side 21*d* along the left side 21*b* of the headwear 10 and a guide 25, which directs the second stretchable material 40*b* towards the rear side 21*d* along the left side 21*b* of the headwear 10. If a guide 25 is used in an embodiment, the second stretchable material 40*b* enters the guide 25 along the left side 21*b* and a guide 25 along the right side 21*c* and exits the guide 25 before the rear side 21*d*. In another embodiment, the second stretchable material 40*b* enters the guide 25 along the left side 21*b* and a guide 25 along the right side 21*c* and exits the guide 25 on the rear side 21*d*. The present invention may also use one or more guide 25 on the front side 21*a* or the rear side 21*d* of the headwear 10. Depending on the headwear 10, the second stretchable material 40*b* may be attached to the left side 21*b* near the rear side 21*d*, even if a guide 25 is used.

Figure 8:
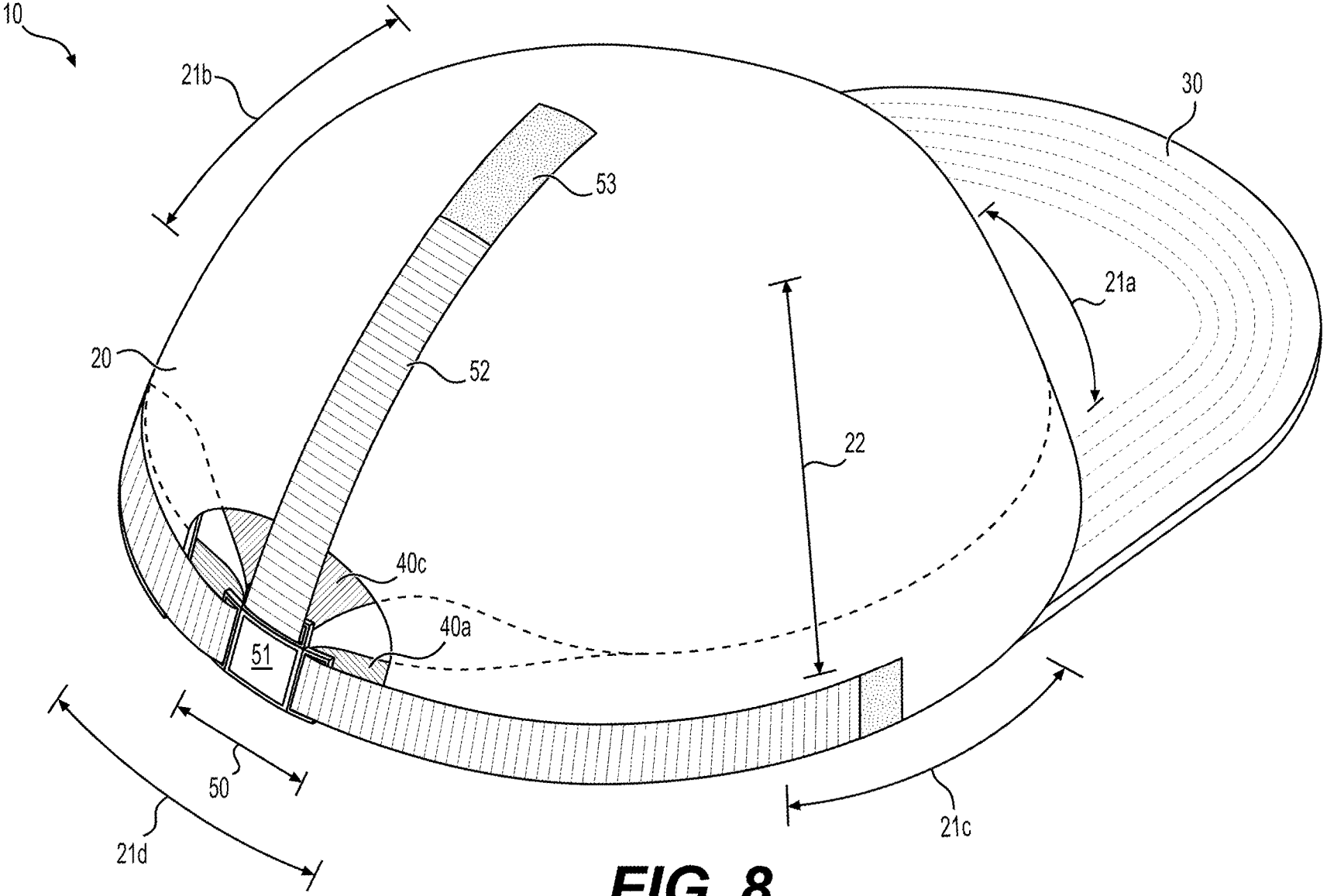
FIG. 8 is a second perspective view of yet another embodiment of the headwear, specifically a baseball-style cap, that depicts a back area of the headwear.
Figure 9:
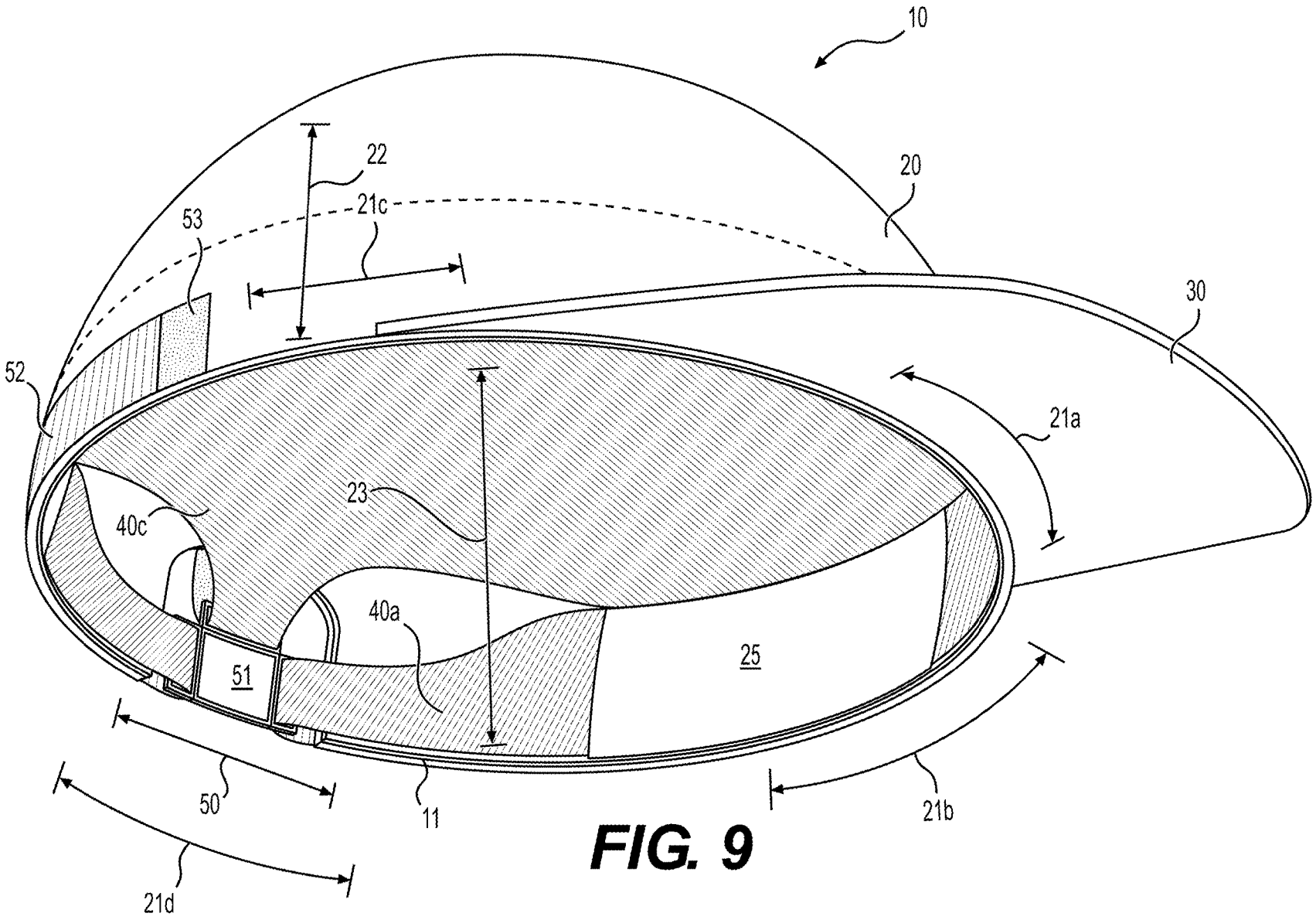
FIG. 9 is a third perspective view of yet another embodiment of the headwear, specifically a baseball-style cap, that depicts an under area of the headwear.

The third stretchable material 40*c* will now be discussed in greater detail. The compression system 40 may also include a third stretchable material 40*c*. The third stretchable material 40*c* may be one continuous piece or two or more pieces functioning as a uniform piece. The third stretchable material 40*c* is preferably a singular piece. The third stretchable material 40*c* covers the scalp along a vertical portion of the headwear 10 and stretches from the front side 21*a* of the crown 20 to the rear side 21*d*. Referring to FIGS. 8 and 9, the third stretchable material 40*c* can be adjacent to the first stretchable material 40*a* or the second stretchable material 40*b*. The third stretchable material 40*c* may be connected, completely or partially to the first stretchable material 40*a*, but connection is not required. Preferably, the third stretchable material 40*c* is incorporated into headwear 10 having a first stretchable material 40*a* and a second stretchable material 40*b* and is adjacent to the second stretchable material 40*b*. The third stretchable material 40*c* may be connected, completely or partially to the second stretchable material 40*b*, but connection is not required. The third stretchable material 40*c* may be connected, to the first stretchable material 40*a*, but connection is not required. The third stretchable material 40*c* can be attached to the first stretchable material 40*a* and the second stretchable material 40*b* by any means capable of attaching fabric layers together.

The third stretchable material 40*c* runs along a vertical portion of the crown 20 up the front side 21*a* of the interior surface 23 of the headwear 10 towards the rear side 21*d*. The third stretchable material 40*c* can range in length starting from the front side 21*a* of the crown 20 to the rear side 21*d* of from about 5 cm to about 100 cm. Preferably, the third stretchable material 40*c* ranges from about 15 cm to about 50 cm. More preferably, the third stretchable material 40*c* ranges from about 20 cm to about 30 cm. The third stretchable material 40*c* can range in width starting from the left side 21*b* of the crown 20 to the right side 21*c* of from about 5 cm to about 60 cm. Preferably, the third stretchable material 40*c* ranges from about 15 cm to about 40 cm. More preferably, the third stretchable material 40*c* ranges from about 20 cm to about 30 cm. The increased size of the third stretchable material 40*c* allows increased surface area to contact with the hair of a wearer in order to compress the hair while wearing the headwear 10. Depending on the headwear 10, the size of the third stretchable material 40*c* may stay uniform throughout. Alternatively, the size of the third stretchable material 40*c* may vary in size to accommodate the headwear 10.

The third stretchable material 40*c* of the compression system 40*a-c* is attached to the interior surface 23 of the front side 21*a* of the crown 20. The third stretchable material 40*c* may be attached horizontally at one or more points along the interior surface 23 of the front side 21*a* of the crown 20. The third stretchable material 40*c* may be attached at a bottom portion, a middle portion or a top portion of the interior surface 23 of a front side 21*a* of the crown 20. Preferably, the third stretchable material 40*c* is attached along the middle portion of the interior surface 23 of the front side 21*a* of the crown 20. The third stretchable material 40*c* may also be attached vertically to the interior surface 23 of the front side 21*a* of the crown 20 at one or more locations in order to secure the third stretchable material 40*c* to the headwear 10. The third stretchable material 40*c* may be attached to the left side 21*b* and the right side 21*c* of the interior surface 23 of the headwear 10 along the top portion of the left side 21*b* and the top portion of the right side 21*c* of the crown 20. The third stretchable material 40*c* may be continuously attached or partially attached to the left side

21*b* and the right side 21*c* or only partially attached to the left side 21*b* and the right side 21*c*. The third stretchable material 40*c* may also be attached at one or more points to the left side 21*b* and one or more points to the right side 21*c* of the interior surface 23 of the headwear 10. For example, in one embodiment, the third stretchable material 40*c* may be attached to a portion of the left side 21*b* near the rear side 21*d* and the right side 21*c* near the rear side 21*d*. In another embodiment, the third stretchable material 40*c* may be attached to the top of the crown 20. The third stretchable material 40*c* may be continuously attached or partially attached to the crown 20. The third stretchable material 40*c* may also be attached at one or more points within the interior surface 23 of the crown 20 of the headwear 10, such as on the rear side 21*d*. A person of ordinary skill in the art can determine whether the third stretchable material 40*c* needs to be attached to the crown 20. The third stretchable material 40*c* may follow along the left side 21*b*, the right side 21*c* and/or the crown 20 of the headwear 10 using a guide 25. In one embodiment, the third stretchable material 40*c* is inserted into at least one guide 25, which directs the third stretchable material 40*c* towards the rear side 21*d* along the top of the headwear 10. As described herein, the guide 25 may be made of similar material as the compression system 40*a-c*.

The adjustment system 50 will now be discussed in greater detail. The compression system 40*a-c* of the present invention is attached to an adjustment system 50. The adjustment system 50 allows a wearer of the headwear 10 to selectively tighten the compression system 40*a-c* to achieve a desired compression of one or more portions of the wearer's hair. Specifically, the adjustment system 50 is designed to allow a wearer to tighten the first stretchable material 40*a*, the second stretchable material 40*b* and/or the third stretchable material 40*c* of the compression system 40*a-c*. The adjustment system 50 of the present invention is made up of one or more tightening means 52 and one or more fastening means 51. The tightening means 52 may include one or more straps, preferably made of stretchable material such as an elastic, high-performance material, microfiber, cotton, polyester, silk, satin, velvet, or other fabric.

The tightening means 52 is attached to the compression system 40*a-c*. The tightening means 52 may be an extension of the compression system 40*a-c* and designed in such a way as to allow the user to pull the tightening means 52 to adjust the compression system 40*a-c*. In another embodiment, the tightening means 52 may be attached to the compression system 40*a-c* such as through stitching, gluing, molding or other attachment method known in the art. The tightening means 52 of the adjustment system 50 is secured using a fastening means 51 and may be secured to the headwear 10 using a connector 53. The fastening means 51 allows the tightening means 52 to be connected, adjusted and/or secured to a connector 53 by a wearer. The fastening means 52 may include one or more fasteners known in the art such as buckles with eyelets, VELCRO®, plastic snap adjusters, luggage buckles, sliding snaps, button fasteners, or elastic.

Referring to FIGS. 1-5, in one embodiment, the adjustment system 50 may be comprised of a horizontal fastening means 52 connecting the first stretchable material 40*a* of the compression system 40*a-c*. In another embodiment, the adjustment system 50 may be comprised of a diagonal fastening means 52 connecting the second stretchable material 40*b* of the compression system 40*a-c*. In yet another embodiment, the adjustment system 50 may be comprised of a vertical fastening means 52 connecting the third stretchable material 40*c* of the compression system 40*a-c*. In still another embodiment, the adjustment system 50 may be comprised of a horizontal and a diagonal fastening means 52 connecting the first stretchable material 40*a* of the compression system 40*a-c* a second stretchable material 40*b* of the compression system 40*a-c*. Referring to FIGS. 8 and 9, in yet another embodiment, the adjustment system 50 may be comprised of a vertical fastening means 52 and horizontal fastening means 52 connecting the first stretchable material 40*a*, second stretchable material 40*b* and/or third stretchable material 40*c* of the compression system 40*a-c*. In still another embodiment, the adjustment system 50 may be comprised of a vertical, horizontal, and a diagonal fastening means 52 connecting the first stretchable material 40*a*, second stretchable material 40*b*, and third stretchable material 40*c* of the compression system 40*a-c*. The tightening means 52 of the headwear may be secured to the headwear 10 using a connector 53. The connector 53 is often located on the exterior surface 22 of the headwear 10. The connector 53 may be one or more fasteners known in the art such as buckles with eyelets, VELCRO®, plastic snap adjusters, luggage buckles, sliding snaps, button fasteners, or elastic. The connector may be located on the any side 21*a-d* or top of the crown 20 of the headwear 10.

The elements of headwear 10 discussed above may be assembled through various methods of manufacture. Sample methods will be discussed below to provide a greater understanding regarding the structure of headwear 10, the compression system 40*a-c*, and the adjustment system 50. The exterior surface 22 of the headwear 10 is assembled according to conventional methods known in the art. The interior surface 23 of the headwear 10 is assembled to incorporate the compression system 40*a-c*. In one embodiment, with reference to FIGS. 1-4, the headwear 10 is a visor. The interior surface 23 of the front side 21*a* of the headwear 10 is formed with a first stretchable material 40*a* of the compression system 40*a-c*. The first stretchable material 40*a* is attached to the crown 20 of the headwear 10. Specifically, the first stretchable material 40*a* is attached to the lower portion of the interior surface 23 of the front side 21*a* of the headwear 10 to prevent unraveling, ensure strength, and improve the overall aesthetics of headwear 10. In this embodiment, the first stretchable material 40*a* is made of a stretchable satin, spandex and polyester blend material. The first stretchable material 40*a* is similar in height to the front side 21*a* of the headwear 10. Specifically, it is within the range of 4 cm to 6 cm. The first stretchable material 40*a* is attached along a vertical portion of the middle portion of the interior surface 23 of the front side 21*a* of the headwear 10. The first stretchable material 40*a* is also attached along an interior surface 23 of the headwear 10 to the left side 21*b* and right side 21*c* along a lower edge of the crown 20 in opposite directions as indicated by arrows in FIG. 2.

The first stretchable material 40*a* is inserted into a guide 25 on the left side 21*b* and a guide 25 on the right side 21*c*. The at least one guide 25 is attached to the headwear 10 along the lower portion of the interior surface 23 and along the top of the visor headwear 10. In this embodiment, the guide 25 is made of a stretchable satin, spandex and polyester blend material. The first stretchable material 40*a* exits the guide 25 at the beginning of a rear side 21*d* of the headwear 10. In the case of a visor, there are two rear sides 21*d* of the headwear 10. Therefore, the first stretchable material 40*a* that is attached to the left side 21*b* of the headwear 10 and is inserted into a guide 25 on the left side 21*b*, and exits the guide 25 on a left rear side 21*d* of the headwear 10. Similarly, the first stretchable material 40*a* that is attached to the right side 21*c* of the headwear 10 and is inserted into a guide 25 on the right side 21*c*, and exits the guide 25 on a right rear side 21*d* of the headwear 10. The size of the first stretchable material 40*a* exiting the guide 25 declines to about 50% of the width of the visor headwear 10 to approximately within a range of about 2 cm to about 3 cm.

Figure 4:
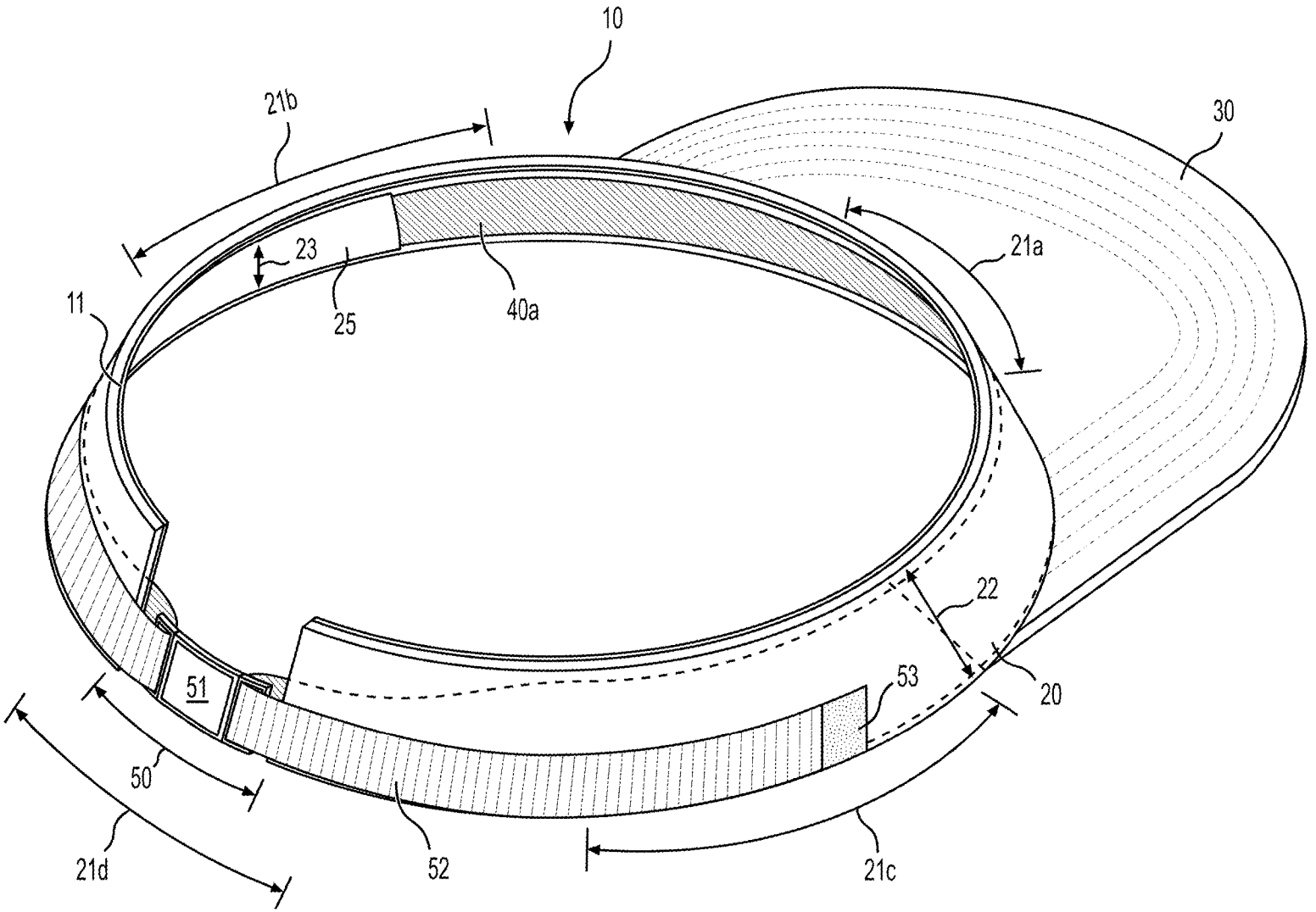
FIG. 4 is a second perspective view of an alternate embodiment of the headwear, specifically a visor, that depicts a back area of the headwear.

On the rear side 21*d* of the headwear 10, the first stretchable material 40*a* is attached to an adjustment system 50. Specifically, the first stretchable material 40*a* is looped into a fastening means 51 of the adjustment system 50, which includes a loop system on opposite sides of a buckle-style fastener. The buckle-style fastener may be unsnapped or disconnected, separating the buckle-style fastener into two separate pieces. The first stretchable material 40*a* that is on the left rear side 21*b* of the headwear 10 is attached to a loop on the left side 21*b* of the headwear 10. Similarly, the first stretchable material 40*a* that is on the right rear side 21*d* of the headwear 10 is attached to a loop on the right side 21*c* of the headwear 10. After exiting the loop, the first stretchable material 40*a* is attached to a tightening means 52 of the adjustment system 50. The underside of the tightening means 52 of the adjustment system 50 is comprised of a VELCRO® connector 53. Once the buckle-style fastener of the fastening means 51 is snapped, a user is able to pull the tightening means 52 of the adjustment system 50, which tightens the first stretchable material 40*a* of the compression system 40*a-c* over the hair of a wearer. The tightening means 52 of the adjustment system 50 may be pulled by a user and fastened to a counterpart VELCRO® connector 53 on the exterior surface 22 of the right side 21*c* of the headwear 10 and the left side 21*b* on the exterior surface 22 of the headwear 10 as depicted in FIG. 4.

Figure 5:
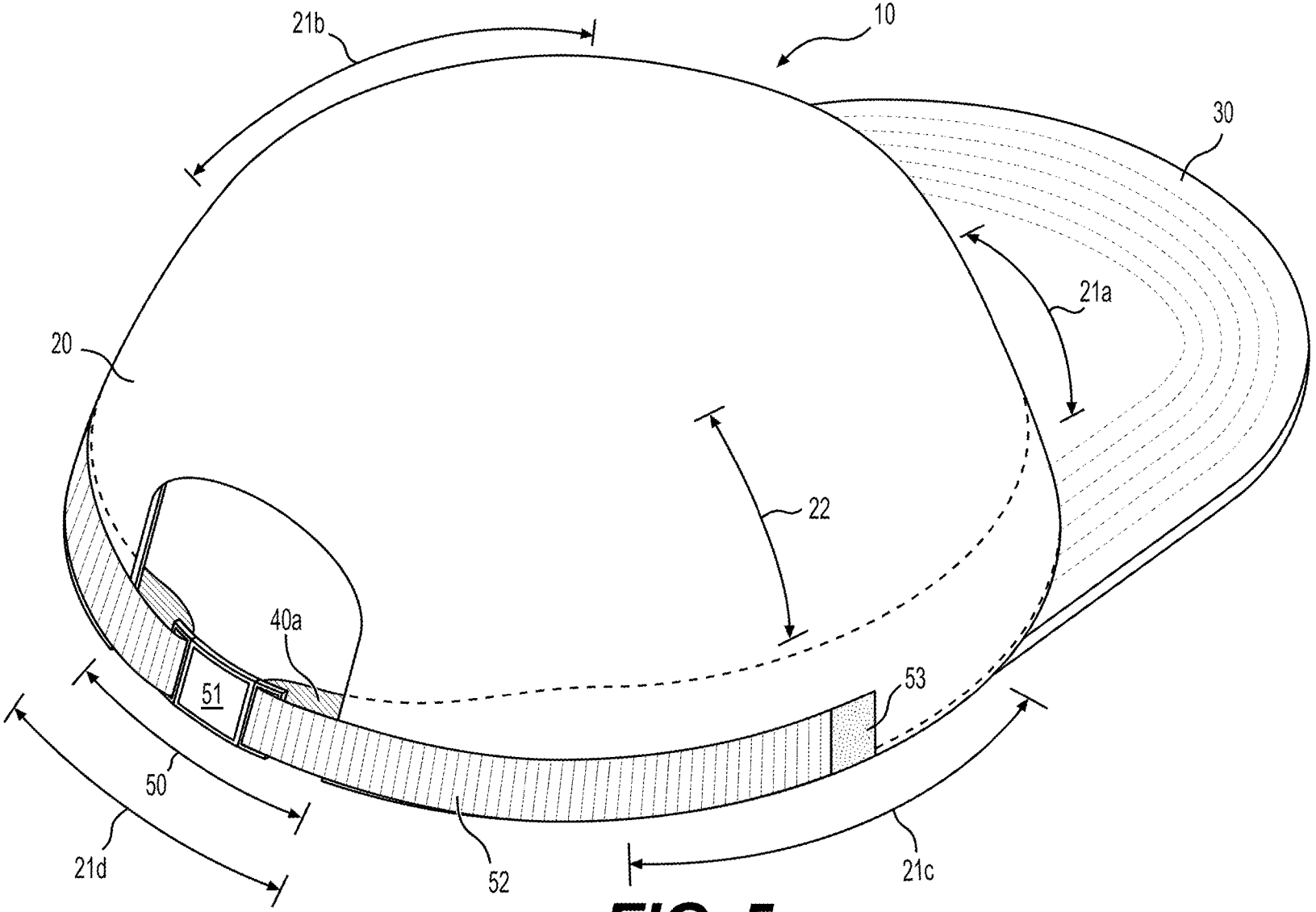
FIG. 5 is a second perspective view of an alternate embodiment of the headwear, specifically a baseball-style cap, that depicts a back area of the headwear.

In alternate embodiments, the fastening means 51 to the adjustment system 50 includes a tightening means 52 on only one side, such as on the right side 21*c* of the exterior surface 22 of the headwear 10 as depicted in FIG. 2. In this embodiment, the first stretchable material 40*a* enters the loop system of the fastening means 51 of the adjustment system 50 on only one side. Specifically, the first stretchable material 40*a* is attached to a tightening means 52 of the adjustment system 50 that may be pulled by a user and fastened to a VELCRO® connector 53 on the exterior surface 22 of the right side 21*c* of the headwear 10 as depicted in FIG. 2. The inclusion of the compression system 40*a-c* and adjustment system 50 of the present invention may be incorporated into alternative style headwear 10. For example, as depicted in FIGS. 5, the headwear 10 is a baseball-style cap. In this embodiment, the headwear 10 includes a first stretchable material 40*a* within the compression system 40*a-c* and the adjustment system 50 described above.

In another embodiment, the headwear 10 includes a first stretchable material 40*a* and a second stretchable material 40*b* as depicted in FIGS. 6 and 7. With reference to FIGS. 6 and 7, the headwear 10 is a baseball-style cap. The interior surface 23 of the front side 21*a* of the headwear 10 is formed with a first stretchable material 40*a* of the compression system 40*a-c*. The first stretchable material 40*a* is attached to the crown 20 of the headwear 10 as described above. Adjacent to the first stretchable material 40*a*, the headwear 10 includes a second stretchable material 40*b*. Specifically, the second stretchable material 40*b* is attached to the top portion of the interior surface 23 of the front side 21*a* of the headwear 10. In this embodiment, the second stretchable material 40*b* is made of a stretchable satin and polyester blend material. The width of the second stretchable material 40*b* is in a range of 5 cm to 8 cm. The second stretchable material 40*b* is also attached along an interior surface 23 of the headwear 10 to the left side 21*b* and right side 21*c* and along a middle section of the crown 20 in opposite directions. The second stretchable material 40*b* is attached to the headwear 10 on a rear side 21*d* of the headwear 10. The width of the second stretchable material 40*b* on the rear side 21*d* of the crown 20 of the headwear 10 declines to about 70-80% of the width of the second stretchable material 40*b* of the headwear 10 to approximately within a range of about 2 cm to about 3 cm or the same as the width of the first stretchable material 40*a*.

On the rear side 21*d* of the headwear 10, the second stretchable material 40*b* is attached to the first stretchable material 40*a* to overlap and then the first stretchable material 40*a* and the second stretchable material 40*b* are attached to an adjustment system 50. Specifically, the first stretchable material 40*a* and second stretchable material 40*b* are looped into a fastening means 51 of the adjustment system 50, which includes a loop system on two sides of a buckle-style fastener as discussed above. The first stretchable material 40*a* and second stretchable material 40*b* on the left rear side 21*d* of the headwear 10 are attached to a loop on the left side 21*b* of the headwear 10. Similarly, the first stretchable material 40*a* and second stretchable material 40*b* that are on the right side 21*c* of the headwear 10 are attached to a loop on the right side 21*c* of the headwear 10. After exiting the loop, the first stretchable material 40*a* and second stretchable material 40*b* are attached to a tightening means 52 of the adjustment system 50. The underside of the tightening means 52 of the adjustment system 50 is comprised of a VELCRO® connector 53. Once the buckle-style fastener of the fastening means 51 is snapped, a user is able to pull the tightening means 52 of the adjustment system 50, which tightens the first stretchable material 40*a* and second stretchable material 40*b* of the compression system 40*a-c* over the hair of a wearer. The tightening means 52 of the adjustment system 50 may be pulled by a user and fastened to a counterpart VELCRO® connector 53 on the exterior surface 22 of the right side 21*c* of the headwear 10 and the left side 21*b* of the headwear 10 as depicted in FIG. 6.

In another embodiment, the headwear 10 includes a first stretchable material 40*a* and a third stretchable material 40*c*. With reference to FIGS. 8 and 9, the headwear 10 is a baseball-style cap. The interior surface 23 of the front side 21*a* of the headwear 10 is formed with a first stretchable material 40*a* of the compression system 40*a-c*. The first stretchable material 40*a* is attached to the crown 20 of the headwear 10 as described above. Adjacent to the first stretchable material 40*a*, the headwear 10 includes a third stretchable material 40*c* that covers a top portion of the crown 20 of the headwear 10. Specifically, the third stretchable material 40*c* is attached to the top portion of the interior surface 23 of the front side 21*a* of the headwear 10. In this embodiment, the third stretchable material 40*c* is made of a stretchable spandex and polyester blend material. The width of the third stretchable material 40*c* is in a range of from about 20 cm to about 30 cm and covers the length of the top of the crown 20. The second stretchable material 40*b* is also attached along an interior surface 23 of the headwear 10 to the left side 21*b* and right side 21*c* and along a middle section of the crown 20. The third stretchable material 40*c* is attached to the headwear 10 on a rear side 21*d* of the headwear 10. The width of the third stretchable material 40*c* on the rear side 21*d* of the crown 20 of the headwear 10 decline to about 10-15% of the width of the third stretchable material 40*c* of the headwear 10 to approximately within a range of about 2 cm to about 3 cm, the same as the range of the first stretchable material 40*a*.

On the rear side 21*d* of the headwear 10, the third stretchable material 40*c* is attached to the first stretchable material 40*a* to overlap and is then attached to an adjustment system 50. Specifically, the first stretchable material 40*a* is looped into a fastening means 51 of the adjustment system 50, which includes a loop system on three sides of a buckle-style fastener. The third stretchable material 40*c* is into the top of the fastening means 51 of the adjustment system 50, which also includes a loop system on the top side of the buckle-style fastener. The buckle may be unsnapped or disconnected, separating the buckle-style fastener into two separate pieces. The top loop for the third stretchable material 40*c* may be on either side of the separated buckle-style fastener. After exiting the loop, the first stretchable material 40*a* and third stretchable material 40*c* are attached to a tightening means 52 of the adjustment system 50. The underside of the tightening means 52 of the adjustment system 50 is comprised of a VELCRO® connector 53. Once the buckle of the fastening means 51 is snapped, a user is able to pull the tightening means 52 of the adjustment system 50, which tightens the first stretchable material 40*a* and the third stretchable material 40*c* of the compression system 40*a-c* over the hair of a wearer. The tightening means 52 of the adjustment system 50 may be pulled by a user and fastened to a counterpart VELCRO® connector 53 located on the exterior surface 22 of the right side 21*c* of the headwear 10, the left side 21*b* of the headwear 10, and on the top of the crown 20 as depicted in FIG. 8. Specifically, the tightening means 52 attached to the first stretchable material 40*a* on the right side 21*c* of the headwear is attached to a connector 53 on the exterior surface 22 of the right side 21*c* of the headwear 10; the tightening means 52 attached to the first stretchable material 40*a* on the left side 21*b* of the headwear is attached to a connector 53 on the exterior surface 22 of the left side 21*b* of the headwear 10; and the tightening means 52 attached to the third stretchable material 40*c* is attached to a connector 53 on the exterior surface 22 of the top of the crown 20 of the headwear 10.

The specific embodiments of headwear 10, as disclosed above, may include various modifications within the scope of the present invention. For example, a sweatband 11, may be incorporated into the crown 20 between the crown 20 and the compression system 40*a-c*. The sweatband 11 may be attached to the crown 20 and compression system 40*a-c*, which provides support for sweatband 11. Headwear 10 often includes a brim 30 as depicted in FIGS. 1-9 with at least one semi-rigid polymer brim board sandwiched between textile elements. Brim 30 may incorporate a conventional brim board configuration. In general, the compression system 40*a-c* is attached to the headwear 10 at a plurality of points. When the compression system 40*a-c* is tightened using the adjustment system 50, thereby modifying the dimensions of the compression system 40*a-c*, the compression system 40*a-c* may accommodate individuals with various head dimensions. The conventional brim board, however, could limit the degree of deformation. Brim 30 may be formed to have an alternate configuration, such as being made of more than one brim 30 board that permits headwear 10 to deform. Accordingly, brim 30 may have a configuration that complements the compression system 40*a-c* of headwear 10 and permits the brim 30 to stretch.

The present invention is disclosed above and in the accompanying drawings with reference to a variety of embodiments. As required, detailed embodiments of the present invention are disclosed herein; however, while various embodiments and examples of this invention have been described above, these descriptions are given for purposes of illustration and explanation, and not limitation. Variations, changes, modifications, and departures from the systems, apparatus and methods disclosed above may be adopted without departure from the spirit and scope of this invention. Moreover, specific structural and functional details disclosed herein are not to be interpreted as limiting, but merely as a basis for the claims and as a representative basis for teaching one skilled in the art to variously employ the present invention. It will be apparent to those skilled in the art that many changes and substitutions may be made to the foregoing description of preferred embodiments and examples without departing from the spirit and scope of the present invention, which is defined by the appended claims.

Further, the purpose of the Abstract is to enable the various patent offices and the public generally, and especially practitioners in the art such as officers and those who manage, supervise, purchase and/or evaluate technology for or on behalf of agencies or departments employing or relying on the same, but who may not be familiar with patent or legal terms or phraseology, to determine quickly from a cursory inspection the nature and essence of the technical disclosure of the application. The Abstract is not intended to be limiting as to the scope of the invention in any way.

We claim:

1. An article of headwear capable of compressing at least a portion of a head of a wearer, the headwear comprising:

(i) a crown having (a) a circumference, (b) a front side, (c) a rear side, (d) a left side, and (d) a right side;

(ii) a first guide attached to an interior of the front side of the crown, the first guide having a first end and a second end;

(iii) a compression system for compressing at least the portion of the head of the wearer, the compression system comprising a first stretchable material and a second stretchable material; and (iv) an adjustment system for adjusting the compression system;

wherein:

the adjustment system for adjusting the compression system is attached to the compression system;

the compression system is attached to at least a first portion of the circumference of the crown;

the first stretchable material enters the first guide at the first end and exits the first guide at the second end; and the second stretchable material is directly connected to a top of the adjustment system.

2. The article of headwear of claim 1, wherein the first stretchable material compresses in a direction of the circumference of the headwear.

3. The article of headwear of claim 1, wherein the first stretchable material is a textile.

4. The article of headwear of claim 1, wherein the adjustment system comprises a fastening means.

5. The article of headwear of claim 4, wherein the adjustment system further comprises a tightening means.

6. The article of headwear of claim 1, wherein a sweatband is attached to the crown.

7. The article of headwear of claim 1, wherein the headwear further comprises a second guide having a third end and a fourth end, wherein the second guide is attached to an interior of at least one of the right side or the left side of the crown.

8. The article of headwear of claim 7, wherein the compression system enters the second guide at the third end and exits the second guide at the fourth end.

9. A cap capable of being selectively compressed by a wearer around a head of the wearer, the cap comprising:

(i) a crown having (a) a circumference, (b) a front side, (c) a rear side, (d) a left side, (e) a right side, and (f) a top;

(ii) a first a guide attached to the interior of the front side of the crown, the first guide having a first end and a second end;

(iii) a compression system for compressing at least a portion of the head of the wearer, the compression system comprising a first stretchable material and a second stretchable material; and (iv) an adjustment system attached to the compression system, wherein:

the adjustment system for adjusting the compression system is attached to the compression system;

the compression system is attached to at least a first portion of the circumference of the crown;

the first stretchable material enters the first guide at the first end and exits the first guide at the second end; the second stretchable material covers a portion of the top of the crown; the second stretchable material is directly connected to a top of the adjustment system, and wherein the adjustment system allows the wearer to selectively tighten the compression system to compress at least a portion of the head of the wearer.

10. The cap of claim 9, wherein a sweatband is attached to the crown.

11. The cap of claim 9, further comprises a second guide having a third end and a fourth end, wherein the second guide is attached to the interior of at least one of the right side of the crown or the left side of the crown.

12. The cap of claim 11, wherein the compression system enters the second guide at the third end and exits the second guide at the fourth end.

* * * * *